US005832860A

United States Patent [19]

Lexau

[11] Patent Number: 5,832,860

[45] Date of Patent: Nov. 10, 1998

[54] TRIM ENHANCING DEVICE FOR A POWER BOAT

[76] Inventor: James R. Lexau, P.O. Box 44, Herald, Calif. 95638

[21] Appl. No.: 72,195

[22] Filed: May 4, 1998

[51] Int. Cl.[6] ..... B63B 1/24

[52] U.S. Cl. ..... 114/274

[58] Field of Search ..... 114/274, 280, 114/284–286, 145 A, 145 R; 440/900

[56] References Cited

U.S. PATENT DOCUMENTS 5,474,012 12/1995 Yamada et al. ..... 114/286
5,493,990 2/1996 Dyer ..... 114/45 A
5,711,241 1/1998 Dyer ..... 114/145 A

*Primary Examiner*—Edward L. Swinehart
*Attorney, Agent, or Firm*—Lothrop & West

[57] ABSTRACT

In order to improve the trim of a power boat ready to accelerate toward "on plane" speed, a deflector plate is deployed by gravity from a substantially horizontal attitude toward a rearward-downward inclination, the deployed plate being located so that a predetermined portion only of the propeller backwash is intercepted. Latching mechanism locks the deflector plate at an optimum angle of deployment until the boat reaches a speed slightly in excess of "planing" speed at which juncture the deflector plate is unlocked by remote control, either automatically or manually. The device can be used either for outboard motor or stern drive propulsion units.

9 Claims, 5 Drawing Sheets

TRIM ENHANCING DEVICE FOR A POWER BOAT

BACKGROUND OF THE INVENTION

1. Field of the Invention

The invention relates to devices for improving the drive trim performance of boats equipped with outboard motors and of boats equipped with stem drive propulsion units drivingly interconnected with the engines of the boats.

2. Prior Art

The most pertinent prior art is U.S. Pat. No. 5,645,009, patented Jul. 8, 1997, by James R. Lexau, applicant herein, for Power Boat Trim Augmentation Device, said patent being incorporated herein by reference.

While the disclosure in the '009 patent teaches structures and operations which afford eminently satisfactory drive trim results in both stem drive and outboard motor installations, some customers prefer a trim enhancing device of a somewhat simplified, more economical nature.

SUMMARY OF THE PRESENT INVENTION

It is an object of the present invention to provide a trim enhancing device which is usable either with outboard motors or stem drive units.

It is another object of the invention to provide such a device which is relatively economical to acquire, and which can be installed either at the factory or by the average power boat owner.

It is yet another object of the invention to provide a self-contained attachment to the anticavitation plate of the customary outboard motor or stem drive unit and which includes a deflector plate movable between a neutral, substantially horizontal attitude and a latched fully deployed angular attitude in which the deflector plate intercepts a predetermined portion only of the propeller backwash, thereby enhancing trim without impairing operational performance.

When planing speed is reached, the deflector plate latch is tripped, either manually or automatically, and the deflector plate, under dynamic water pressure, returns to neutral, or base, position, substantially co-planar with the mounting plate and the anticavitation plate.

When the boat slows or stops, the weight of the deflector plate causes it to deploy, downwardly at an angle, until it reaches fully deployed attitude. At this juncture, the latch plate and more particularly, the accompanying lip, being biased forwardly, again engage the bottom of the rear end of the trip plate, thereby locking the deflector plate in fully deployed attitude, preparatory to the boat's resuming forward motion. The presence of the deployed and locked deflector plate lowers the bow, enhances trim and enables the boat to reach planing speed sooner while adding to the comfort and safety of all those aboard.

BRIEF DESCRIPTION OF THE DRAWING FIGURES

The drawing figures illustrate the best mode presently contemplated of carrying out the invention.

Figure 2:
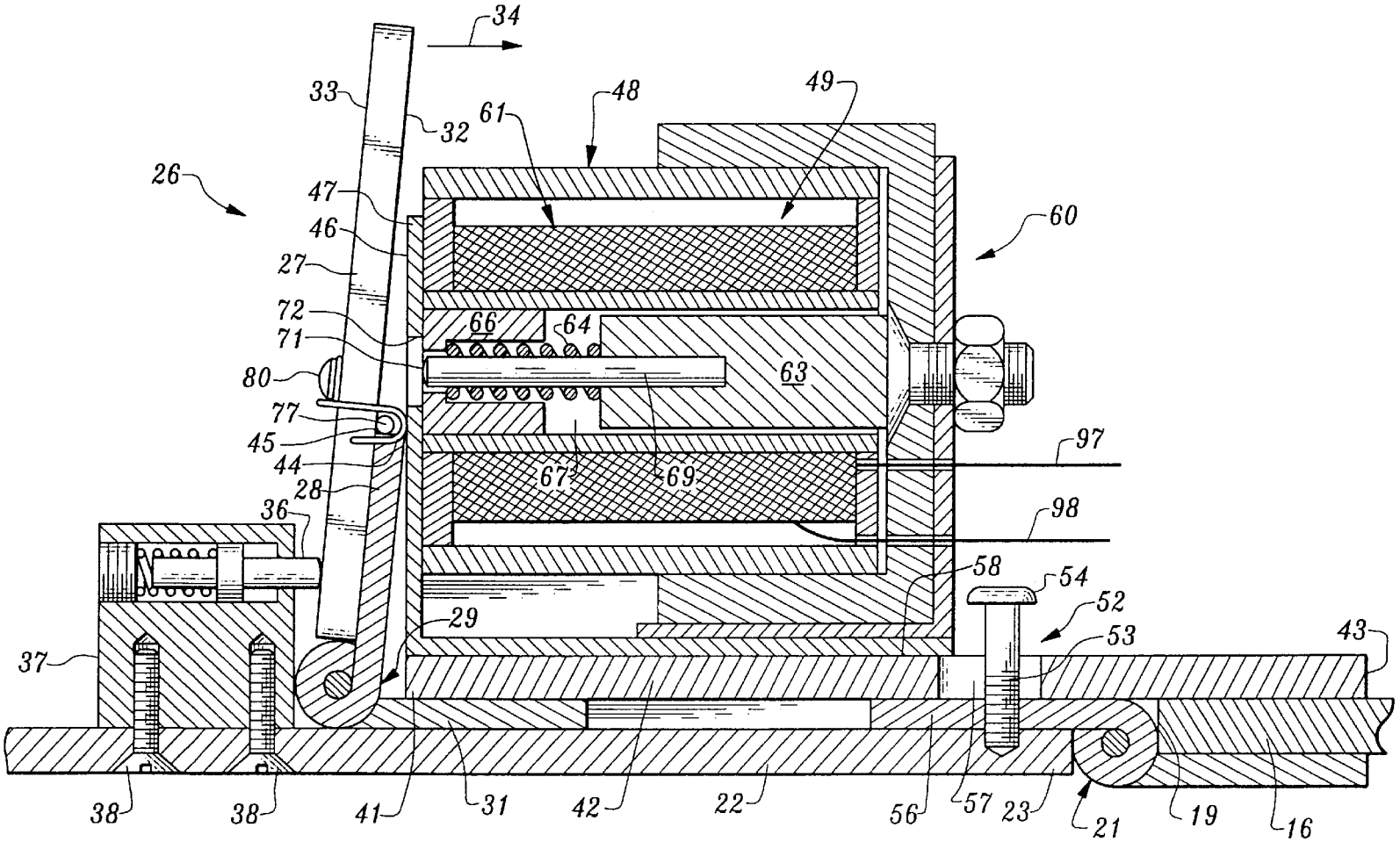
FIG. 2 is a fragmentary side elevational view, to an enlarged scale, of the deflector plate latching mechanism, portions being broken away to reveal internal details, with the deflector plate and related elements in neutral, or base, position.
Figure 3:
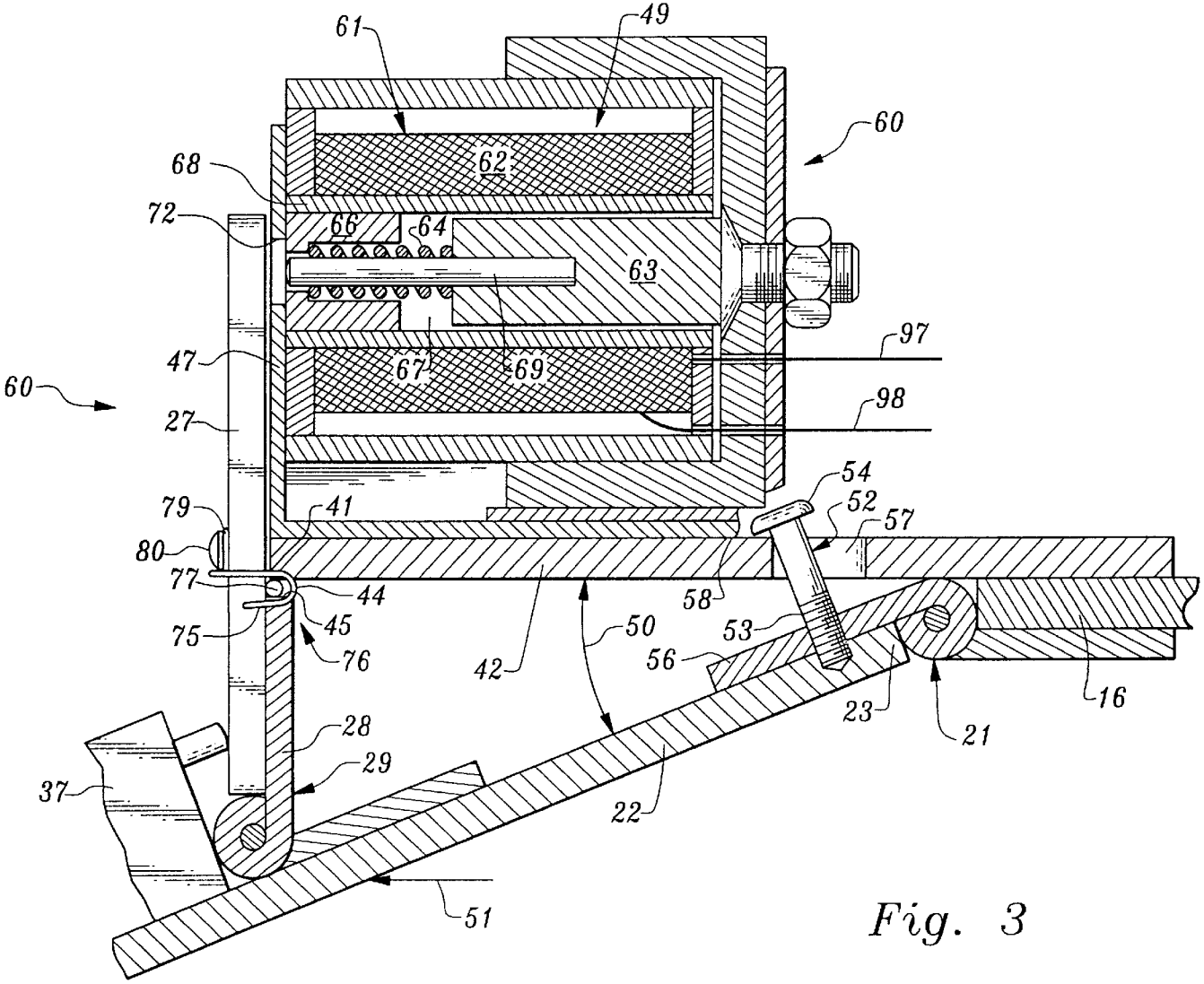
Figure 4:
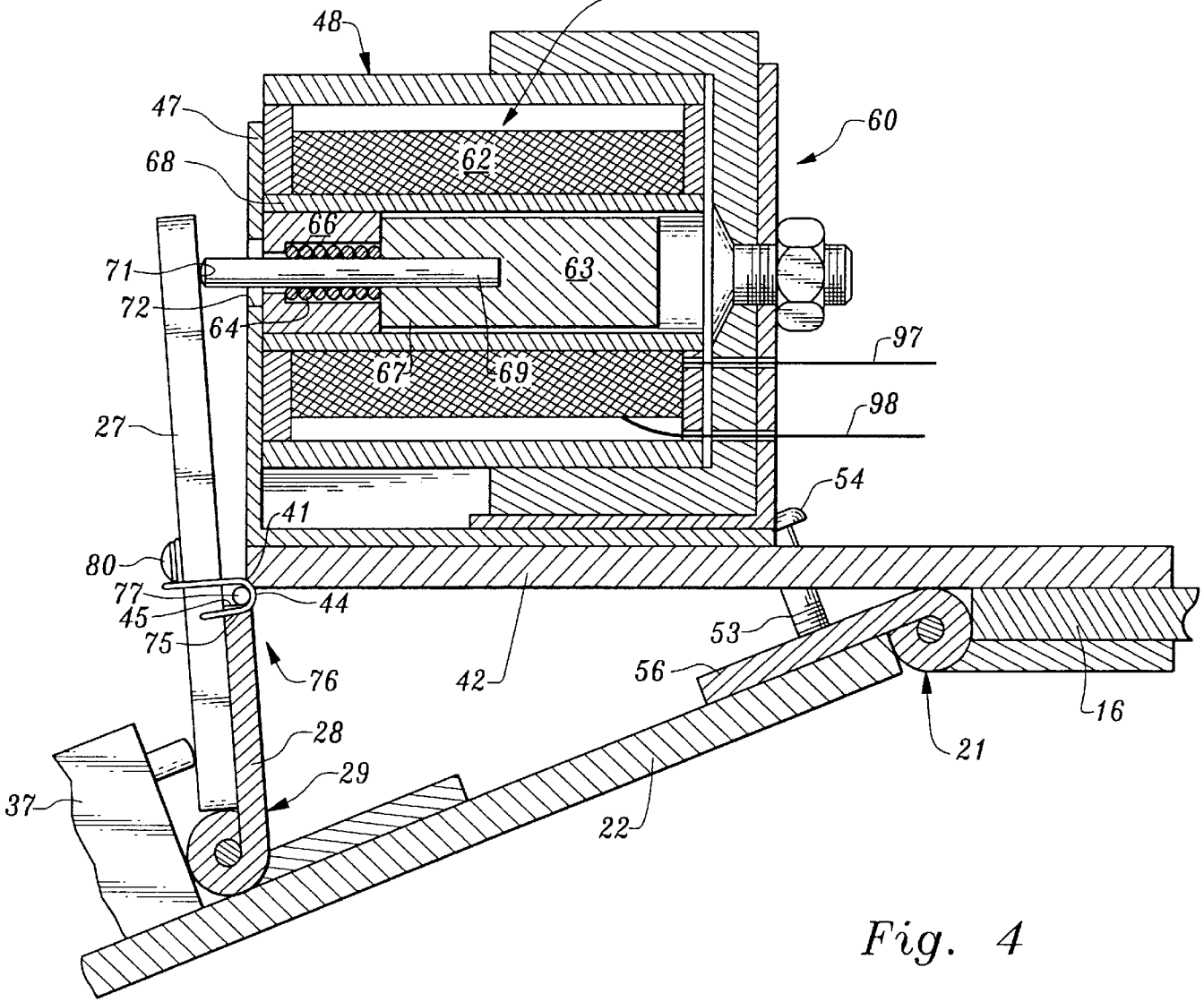
Figure 5:
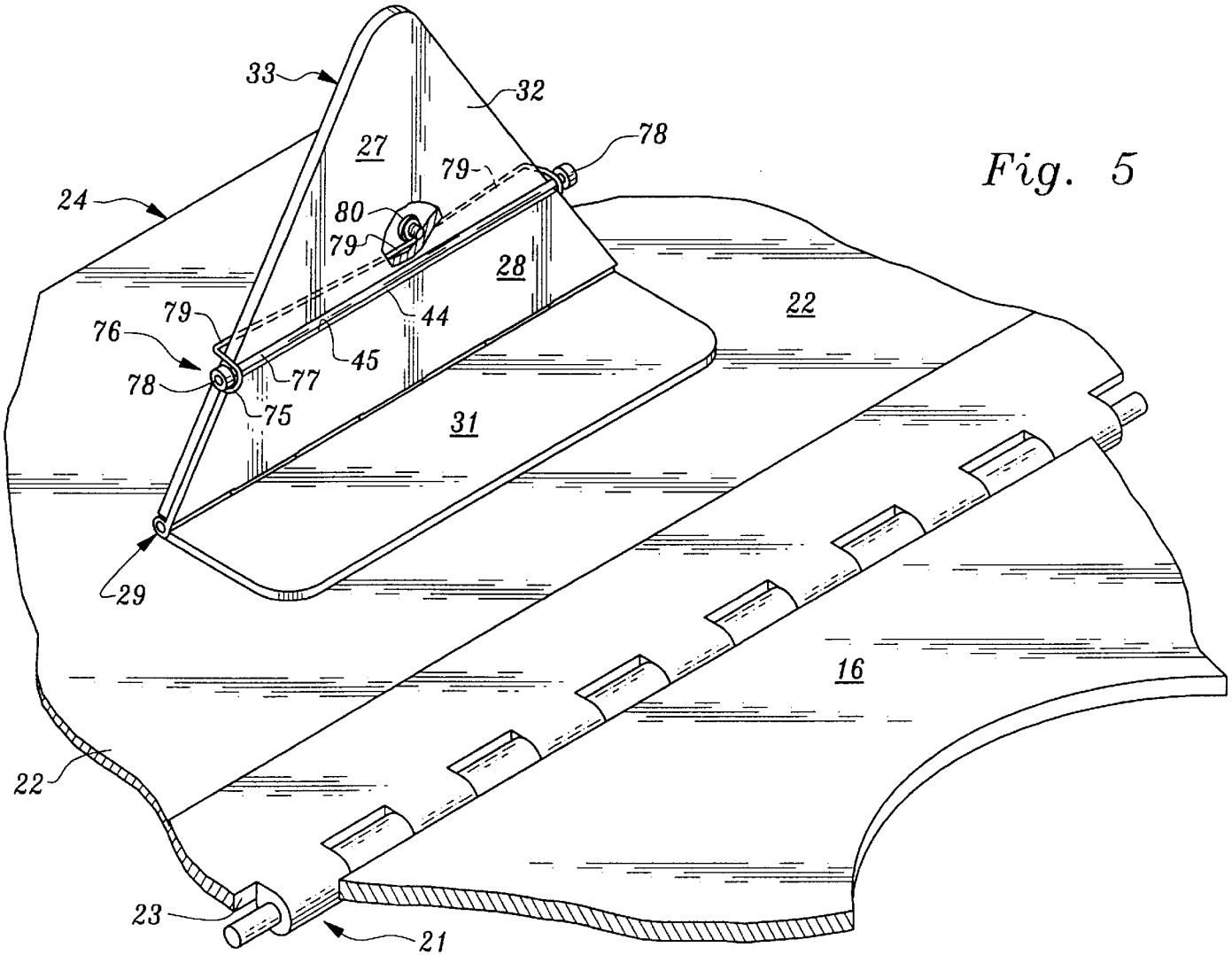

In FIG. 3 is a view similar to FIG. 2 but with the deflector plate and related elements in latched, or locked, condition and in fully deployed attitude;

FIG. 4 is a view similar to FIG. 3 but with the deflector plate and related elements at the moment the latch plate is tripped by the projected plunger on the solenoid core;

FIG. 5 is a fragmentary front perspective view showing the hinged connection between the deflector plate and the latch plate and illustrating the friction-reducing piano wire transversely disposed for rolling movement on the upper lip, or ledge, of the upright hinge leaf, the solenoid and the trip plate being broken away to clarify the disclosure.

DETAILED DESCRIPTION OF PREFERRED EMBODIMENT

For a description of the importance of "trim" in the operation of power boats, either of the stern drive propulsion unit type or of the outboard motor propulsion unit type, reference is made to the previously noted U.S. Pat. No. 5,645,009 granted Jul. 8, 1997.

In the '009 patent, two embodiments of the invention are disclosed, one for each type of propulsion unit.

In the present case, one embodiment suffices to enhance trim in both types of propulsion unit. Thus, in FIG. 1, a single, unified perspective view serves to illustrate, in stylized manner, how both types can be fitted with the trim enhancer of the present invention, assuming that anticavitation plates are part of the propulsion units.

It is appropriate to note, at this point, that whereas the embodiments in the '009 disclosure control the angular attitude of the deflector plate at all stages, the present embodiment utilizes the force of gravity to move the deflector plate from substantially horizontal, or base, or neutral, attitude to fully deployed attitude where the deflector plate is "locked", or latched, in inclined attitude. With the deflector plate in deployed condition, forward motion of the boat and propeller backwash effectively combine to elevate the stem and lower the bow, thereby enhancing trim and enabling the boat to attain desirable planing speed more quickly.

When planing speed has been achieved, the deflector plate latch is tripped, either manually or automatically, and dynamic water pressure impinging on the deployed and unlocked deflector plate forces the deflector plate to pivot back up toward neutral, or base, position, where it remains until the boat reduces speed below a certain amount, or stops, at which juncture gravity again takes over and lowers the deflector plate into fully deployed attitude and locked in place.

Figure 1:
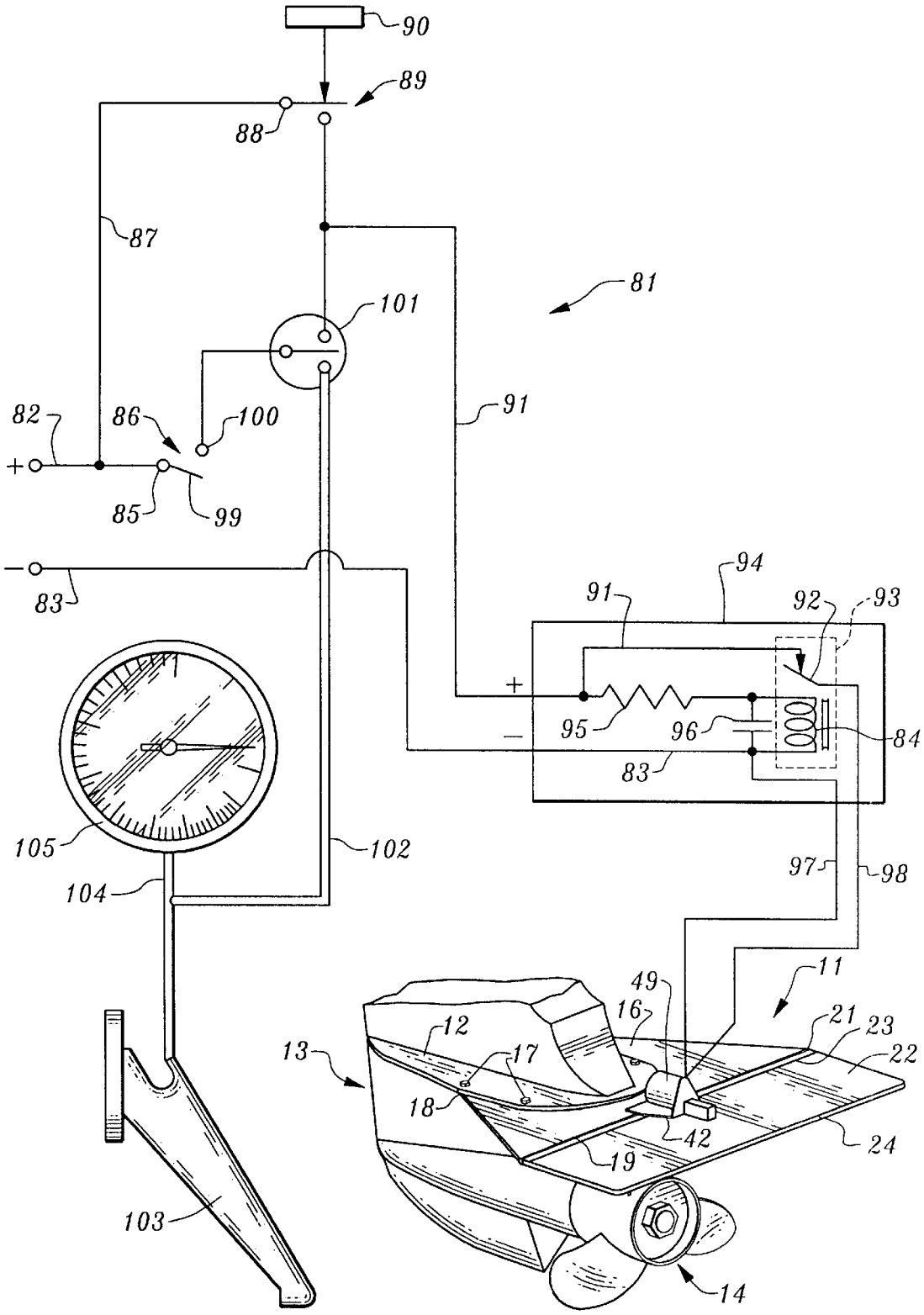
FIG. 1 is a combined perspective view of a lower portion of an outboard motor or stern drive vertical drive unit and schematic diagram of the manual or automatic control components for energizing the solenoid mounted on the trip plate.

As appears most clearly in FIG. 1, the trim enhancing device of the invention, generally designated by the reference numeral 11, is essentially an attachment to the anticavitation plate 12 found on most, if not all, outboard motor/stem drive propulsion units 13 utilizing a propeller 14.

The device of the invention 11 includes a mounting plate 16 attached, as by bolts 17, to the anticavitation plate 12. The mounting plate 16 is preferably fabricated from sturdy, thick gauge, stainless steel and extends from a leading end 18 to a transverse trailing end 19.

Connected to the trailing end 19 of the mounting plate 16 is the forward leaf of a stainless steel hinge 21 of the piano hinge type; and attached to the after leaf of the hinge 21 is a deflector plate 22, also fabricated of sturdy stainless steel material.

The deflector plate 22 is generally rectangular in shape and extends from a forward end 23 connected to the hinge 21 to an after end 24.

In FIGS. 1 and 2, the deflector plate 22, along with the mounting plate 16 and the anticavitation plate 12, is substantially horizontal and is in base position, or neutral attitude. This is to say, that in this neutral attitude, the deflector plate 22 does not intercept any propeller backwash, nor does it create any significant amount of "stern up-bow down" effect on the trim of the boat as a result of dynamic water pressure resulting from motion of the boat in forward mode.

The deflector plate 22, being made of thick gauge stainless steel is quite heavy and under the influence of gravity, tends, even in water, to descend, angularly, about the hinge 21 to a deployed position. Upon reaching a predetermined angular attitude the deflector plate 22 is latched so that optimum results are obtained.

If the fully deployed attitude of the deflector plate 22 is too shallow, dynamic water pressure resulting from propeller backwash plus water flow caused by forward motion of the vessel would be inadequate to lift the stem and lower the bow. If, on the other hand, fully deployed attitude is too deep, or steep, the deflector plate 22 intercepts so much of the propeller backwash that drag is created, slowing boat speed.

The optimum amount of deployment is on the order of twenty degrees.

In order to latch or "lock" the deflector plate 22 in the optimum, fully deployed attitude, the following described structure is provided.

With particular reference to FIGS. 2 and 3, the latching mechanism, generally designated by the reference numeral 26, comprises a latch plate 27 mounted on the upstanding leaf 28 of a hinge 29, preferably of the piano hinge type, the other leaf 31 being secured to the deflector plate 22.

The latch plate 27 includes a forward surface 32 and an after surface 33 and biasing the latch plate in a forward direction, indicated by the directional arrow 34, is a spring-urged to plunger 36 projecting forwardly from a block 37 of hard plastic material made fast to the deflector plate 22 by suitable machine screws 38.

The plunger-biasing structure illustrated in cross-section in FIG. 2 discloses an arrangement that has been used in testing; it being recognized, however, that numerous other embodiments capable of providing a constant forward bias against the latch plate 27 would serve as well as the one shown.

The latching operation results from the intrusion of a solid component into the space immediately below the rear end 41 of a trip plate 42 mounted on its front end 43 on the trailing end 19 of the mounting plate 16.

In the present embodiment, the intrusive solid component is the upper end portion 44 of the upstanding hinge leaf 28. The upper end portion 44 of the leaf 28 provides a lip 45, or ledge, or shelf, which underlies and abuts (through a cross wire 77) the lower rear end comer portion 41 of the trip plate 42 (see FIG. 3).

When the boat is dead in the water, or is moving slowly, the deflector plate 22 angularly descends, as previously described, from the substantially horizontal, or neutral, attitude shown in FIGS. 1 and 2 to a deployed attitude as in FIG. 3. As the deflector plate descends, the upper end portion 44 of the upstanding leaf 28 of the latch plate 27 slides along the adjacent rear face 46 of a vertical rear shield 47 of a housing 48 enclosing a solenoid 49, being biased in a forward direction by the plunger 36.

Then, as soon as the uppermost end of the upstanding leaf 28 and the cross wire 77, clear the adjacent rear end 41 of the trip plate 42, the upper end portion 44 snaps forwardly so as to underlie and engage and "lock" the deflector plate 22 in the fully deployed attitude shown in FIG. 3. Optimally, the angle of deployment 50 is approximately twenty degrees, as previously stated.

With the deflector plate 22 in fully deployed attitude, as shown in FIG. 3, power can be applied by the boat's propulsion unit and the dynamic water pressure acting upon the inclined bottom surface of the deflector plate 22, as indicated in idealized manner by the arrow 51 in FIG. 3, provides a substantial vertically upward component which serves to elevate the stern, lower the bow and more readily enables the boat to attain planing speed.

FIGS. 2 and 3 illustrate a limit stop structure 52 which includes a machine screw 53 having a large cap 54. The bottom portion of the screw 53 is securely threadably anchored in the after leaf 56 of the hinge 21 and in the forward end 23 of the deflector plate whereas the upper, or shank, portion of the screw 53 is disposed within a suitably dimensioned recess 57 in the trip plate 42. The recess 57 allows angular displacement between the deflector plate 22 and the trip plate 42 to occur. When angular displacement very slightly exceeds fully deployed attitude, however, the screw cap 54 comes into abutment with the adjacent top surface 58 of the trip plate 42 and further angular displacement is prevented. At this juncture, the forwardly biased lip 45 moves into place below the rear end 41 of the trip plate 42, latching the fully deployed deflector plate in operative, fully deployed position.

Upon reaching planing speed, proper drive trim is in place and it becomes time to trip the latching mechanism, which has locked the deflector plate 22 in inclined attitude.

The trip mechanism, generally designated by the reference numeral 60, includes not only the trip plate 42 but also the solenoid 49 mounted on the after end portion of the trip plate.

The major function of the solenoid 49 is to provide a rearward force on the latch plate 27 strong enough to overcome the forward bias of the plunger 36, thereby tilting the latch plate 27 in an after direction and dislodging the upper end portion 44, and lip 45, of the upstanding hinge leaf 28, as shown in FIG. 4. With the upper end portion 44, latch lip 45 and cross wire 77, clear of the adjacent end of the trip plate 42, dynamic water pressure (generated by propeller backwash and relative water flow resulting from forward movement of the boat) causes the deflector plate 22 to rise in an angular fashion, to resume the neutral attitude shown in FIG. 2, or approximately so, depending upon the extent of the dynamic water pressure.

With particular reference to FIGS. 2–4, the solenoid 49 comprises, in addition to the housing 48, an electromagnet 61 with the customary coil of wire 62 encompassing a movable, cylindrical core 63 of iron biased forwardly from a central location, relative to the coil 62, by a compression spring 64. The spring 64 is based in a stationary core 66 of iron. The spring's front end bears against and urges forwardly the after end of the movable iron core 63.

As depicted in FIG. 2, the movable iron core 63, when in de-energized condition of the wire coil 62, is located at the forward end of the hollow cylindrical chamber 67 formed by the sleeve 68 on which the wire coil 62 is wound.

Mounted on the after end, or base, of the movable iron core 63, in coaxial fashion, is a plunger 69, or rod, encompassed by the compression spring 64 and projecting rearwardly.

With the movable iron core 63 in the de-energized position shown in FIG. 2, the after end 71, or tip, of the rod 69 is located just forward of a registering opening 72 in the vertical shield 47.

When the wire coil 62 is energized as a result of current flow imposed on the conductors 97 and 98 by an external power source, as will soon be explained, the movable iron core 63 is very rapidly pulled in a rearward direction toward the stationary core 66. This rearward movement causes the tip 71 of the rod 69 to project through the opening 72, as appears in FIG. 4 and into forceful abutment with the latch plate 27.

The abutting rearwardly directed force of the rod 69 considerably exceeds the constant forward bias of the plunger 36. As a consequence, the latch plate 27 is angularly displaced in a rearward direction and the lip 45 and cross wire 77 are dislodged from locked, or latched, position with respect to the superposed lower rear end comer portion 41 of the trip plate 42 (see FIG. 4).

This sequence frees the deflector plate 22 which immediately, under dynamic water pressure, is forced to swing upwardly toward neutral attitude.

Since the latch mechanism in closed, or locked, position forces the lip 45 and the trip plate 42 firmly together, particularly at high speed, a friction-reducing structure 76 is provided to prevent a bind when unlatching is to occur. The structure 76 comprises a cross-wire 77, such as piano wire, transversely disposed on top of the lip 45, the opposite ends of the wire 77 including a pair of disks 78. The structure 76 is held in place a by spring-wire clip 79 secured to the back side 33 of the latch plate 27 by a fastening 80. Forwardly projecting loops 75, or recurved hooks, on opposite ends of the wire clip 79, loosely embrace the adjacent portions of the cross-wire 77, allowing the cross-wire 77 to roll in a fore and aft direction across the lip 45.

Inasmuch as the cross-wire 77 is readily rollable to and fro, it follows that even though the upward force exerted by the lip 45 on the wire 77 and through the wire 77 to the bottom surface of the rear end comer portion 41 of the trip plate 42 is sometimes quite large, the substantial rearward jolt provided by the solenoid rod 69 is always successful in dislodging the latch plate 27 and unlocking the latch structure.

The momentary energization of the solenoid required to unlock the deflector plate 22 is achieved either by manual intervention or, automatically when the boat reaches a predetermined speed, usually a speed somewhat greater than planing speed.

Particular reference is made to FIG. 1 to trace the circuitry utilized to effect unlocking pursuant to either manual or automatic mode.

Power from the boat's electrical system, including a battery (not shown) is connected to the present, electrical unlatching circuit 81 by a positive lead 82 and negative lead 83. The negative conductor 83 is directly connected to one side of the relay coil 84 whereas the positive conductor 82 is led to the base terminal 85 of selector switch 86.

With the selector switch 86 in "manual" mode, as in FIG. 1, current flows from positive lead 82 to conductor 87 connected to the base terminal 88 of a normally open switch 89.

In order to energize the solenoid relay coil 84 in manual fashion it is merely necessary for the person handling the boat to close the manual trip switch 89, by momentarily depressing the manual switch button 90, allowing current to flow through conductor 91 to the solenoid control module 94.

The relay coil 84, along with a normally closed relay switch 92 forms the relay portion 93 of the solenoid control module 94. The solenoid control module 94 also includes an RC timing circuit having a resistance component 95 and a capacitance component 96.

The values of the RC components are chosen so that even though power to the solenoid 49 appears immediately at the solenoid, through conductors 97 and 98 owing to the normally closed relay switch 92, the RC constant will not allow the relay coil 84 to pull and thereby open the relay switch 92 until the voltage across the capacitance 96 and the relay coil 84 has reached the minimum pull-in voltage of the relay 92.

When the relay 92 pulls in, the normally closed contacts of the relay will open, thereby removing power to the solenoid 49. The RC components are selected so that the solenoid 49 is energized for about one second. This provides adequate time for the solenoid core 63 and plunger 69 to snap sharply in a rearward direction, strike the latch plate and dislodge the latch lip 45 and cross wire 77 before returning to forward position under urgency of the spring 64.

Should it be desired to change from manual to automatic operation so that the 20 deflector plate 22 is unlatched when the boat reaches, or slightly exceeds, "on plane" speed, it is merely necessary to change the switch arm 99 of selector switch 86 to "automatic" mode, contacting the terminal 100 of selector switch 86.

By switching to "automatic", current from lead 82 is directed to a pressure switch 101 set to a Pitot pressure slightly above the dynamic water pressure at boat planing speed. The pressure switch 101 is connected by a Pitot tube pressure line 102 to the boat's Pitot tube 103, a branch pressure line 104 leading to the boat's speedometer gauge 105.

When planing speed is slightly exceeded, the pressure switch 101 completes the electrical connection between the terminal 100 and the conductor 91 leading to the solenoid control module 94. From this point, the operation of the RC circuit and the solenoid 49 follows the same procedure described above in connection with manual operation.

I claim:

1. Trim enhancing device for a propeller driven power boat propulsion unit having an anticavitation plate, said device comprising:

a. a mounting plate attached to the anticavitation plate, said mounting plate extending from a leading end to a trailing end;

b. a deflector plate extending from a forward end to an after end;

c. a hinge pivotally connecting said forward end of said deflector plate to said trailing end of said mounting plate for relative angular movement of said deflector plate between a neutral attitude in which said deflector plate is substantially co-planar with said mounting plate and a fully deployed attitude in which said deflector plate is angularly inclined to interrupt a predetermined portion only of the propeller backwash in forward operating mode of the power boat propulsion unit; and, d. latch means for selectively locking said deflector plate in fully deployed attitude while the propulsion unit is accelerating the power boat toward planing speed and unlocking said deflector plate when planing speed is reached, thereby allowing dynamic water pressure to return said deflector plate to neutral attitude.

2. A device as in claim 1 including limit stop means for preventing angular movement of said deflector plate beyond said fully deployed attitude.

3. A device as in claim 2 in which said latch means includes:

a. a generally horizontal trip plate extending from a front end to a rear end, said front end of said trip plate being secured to said mounting plate and said rear end of said trip plate overlying said deflector plate;

b. a generally vertical latch plate hingeably connected to and upstanding from said deflector plate, said latch plate having a front surface and a rear surface;

c. a transversely oriented latch lip mounted on said front surface of said latch plate and projecting forwardly therefrom so as to underlie and engage said rear end of said trip plate and thereby maintain said deflector plate in fully deployed attitude in opposition to dynamic water pressure against said deflector plate;

d. resilient means mounted on said deflector plate for biasing said latch plate in a forward direction so that said latch lip is urged into underlying engagement with said rear end of said trip plate; and, e. means for selectively urging said latch plate rearwardly in opposition to said resilient means and thereby dislodging said latch lip from said trip plate.

4. A device as in claim 3 in which said latch plate urging means includes a solenoid mounted adjacent the rear end of said trip plate, said solenoid including an iron core movable in an after direction when the solenoid is energized and in a forward direction when the solenoid is de-energized; and a fore and aft plunger mounted on the after end of said iron core and movable therewith into abutment with said latch plate with a force overcoming the forward bias of said resilient means.

5. A device as in claim 4 including friction reducing means carried on said latch plate and disposed on the upper surface of said lip so as to be interposed between said lip and the superposed after end portion of said trip plate in said fully deployed attitude of said deflector plate.

6. A device as in claim 5 in which said friction reducing means includes a pair of loops at opposite ends of said latch lip; and a wire embraced loosely by said loops for rolling engagement with said after end of said trip plate.

7. A device as in claim 4 including means for remotely controlling the energization of said solenoid.

8. A device as in claim 7 in which said remotely controlling means include a manually operated component.

9. A device as in claim 4 in which said remotely controlling means include a component automatically operated in response to boat speed.

* * * * *

UNITED STATES PATENT AND TRADEMARK OFFICE

CERTIFICATE OF CORRECTION

PATENT NO. : 5,832,860

DATED : November 10, 1998

INVENTOR(S) : James R. Lexau

It is certified that error appears in the above-identified patent and that said Letters Patent is hereby corrected as shown below:

Column 2, line 44, change "stem" to --stern--
Column 2, line 60, change "stem" to --stern--
Column 3, line 27, change "stem" to --stern--
Column 3, line 62, change "comer" to --corner--
Column 5, line 26, change "comer" to --corner--
Column 6, line 32, delete the numeral 20

Signed and Sealed this

Twenty-third Day of March, 1999

*Attest:*

Q. TODD DICKINSON

*Attesting Officer*

*Acting Commissioner of Patents and Trademarks*